United States Patent [19]

Jewell

[11] 3,956,793

[45] May 18, 1976

[54] CLOSURE HINGE

[75] Inventor: Gordon R. Jewell, Plymouth, Mich.

[73] Assignee: Ford Motor Company, Dearborn, Mich.

[22] Filed: Oct. 3, 1975

[21] Appl. No.: 619,347

[52] U.S. Cl. ..... 16/128.1; 16/163

[51] Int. Cl.[2] ..... E05D 9/00

[58] Field of Search ..... 16/128.1, 138, 128 B, 16/163, 173, 164, 167, 129, 135, 171, 174, 168

[56] References Cited

UNITED STATES PATENTS

| | | | |
|---|---|---|---|
| 2,994,907 | 8/1961 | Hammond | 16/128.1 |
| 3,150,408 | 9/1964 | Belsky | 16/163 |
| 3,594,853 | 7/1971 | Slattery | 16/163 |

*Primary Examiner*—G. V. Larkin

*Attorney, Agent, or Firm*—John J. Roethel; Keith L. Zerschling

[57] ABSTRACT

A hinge for mounting a closure in an opening in a structure for swinging movement about an external hinge line or axis without the use of external hinge devices. The hinge device comprises first and second attachment members mounted on a member of the structure at one boundary of the opening and on the closure, respectively. The first attachment member is mounted internally of the opening and the second attachment member is mounted on the inner side of the closure. A first hinge member is pivotally coupled to the first attachment member for swinging movement about a first axis and a second hinge member is pivotally coupled to the second attachment member for swinging movement about a second axis. The first and second hinge members at their distal ends are pivotally coupled to each other for swinging movement about the third axis intermediate the first and second axes.

The important feature is that the hinge device is mounted with all three of its axes obliquely positioned relative to one another and intersecting at a point outside of the surface of the closure when the latter is in a closed position in the structure opening to provide externally of the opening a pivot point about which the closure is swingable to and from an opened position. Generally, a pair of hinge devices are used to support the closure and the two pivot points define a hinge axis externally of the structure opening.

6 Claims, 5 Drawing Figures

CLOSURE HINGE

BACKGROUND OF THE INVENTION

The hinging of closures in the openings in some structures, particularly the hinging of deck lids, hoods and doors, providing access to luggage compartments, engine compartments and passenger compartments, respectively, of automobiles presents unique problems. It is the practice in automotive design to conceal the hinges so that for aesthetic reasons none of the hinge elements are visible from the exterior of the vehicle structure sheet metal panels. Because deck lids, hoods and doors in vehicle body structure are not flat like an ordinary cupboard door or house door but are contoured to follow the vehicle body contour, they are not swingable about a hinge line or axis located at the edge of the opening in the structure. In order to provide proper movement into and out of the engagement with the weather strips or seals around the opening in the vehicle body structure, the vehicle closures are generally bodily swingable about an axis displaced from the edge of the opening and located interiorly of the compartment. The hinge devices, particularly those mounting the deck lids or hoods, are relatively large devices which intrude into the interior compartment space.

For example, most deck lid hinges have large gooseneck arms which in deck lid closed position projected downwardly into the luggage compartment, see U.S. Pat. No. 2,986,769 issued June 6, 1961 to A. J. Hammond for a deck lid hinge. The hood hinges have compound link systems which protrude into the vehicle engine compartment in closed position of the hood, see U.S. Pat. No. 2,994,907 issued Aug. 8, 1961 to A. J. Hammond for a hood device. The goose-neck arms and compound link systems are required for guiding the deck lids and hoods for swinging movement in a path that avoids interference between the hinge elements and the body structure defining the opening into and out of which the closure is swingable.

It is an object of the present invention to provide a hinge which may be utilized in a closure hinging system in which the closure is swingable about a hinge line or axis located exteriorly of the body structure defined in the opening without requiring exterior exposure of the hinge elements.

SUMMARY OF THE INVENTION

The present invention relates to a hinge device which may be utilized in a hinge system for mounting in an opening in a structure, such as a vehicle body, a closure for swingable movement between closed and opened positions. The hinge device comprises a first attachment member mounted on a structural member of the structure at one boundary of the opening therein and a second attachment member mounted on the closure. The first attachment member is mounted internally of the opening and the second attachment member is mounted on the underside of the closure. A pivot means pivotally couples the distal ends of the first and second hinge members to each other for swinging movement about the third axis intermediate the first and second axes. The hinge device is mounted with all three axes obliquely positioned relative to one another and intersecting at a point outside of the surface of the closure when the latter is in a closed position in the structure opening to provide externally of the opening a pivot point about which the closure is swingable to and from an opened position.

DESCRIPTION OF THE DRAWINGS

Further features and advantages of the present invention will be made more apparent as this description proceeds, reference being had to the accompanying drawings, wherein.

DETAILED DESCRIPTION OF THE INVENTION

Figure 1:
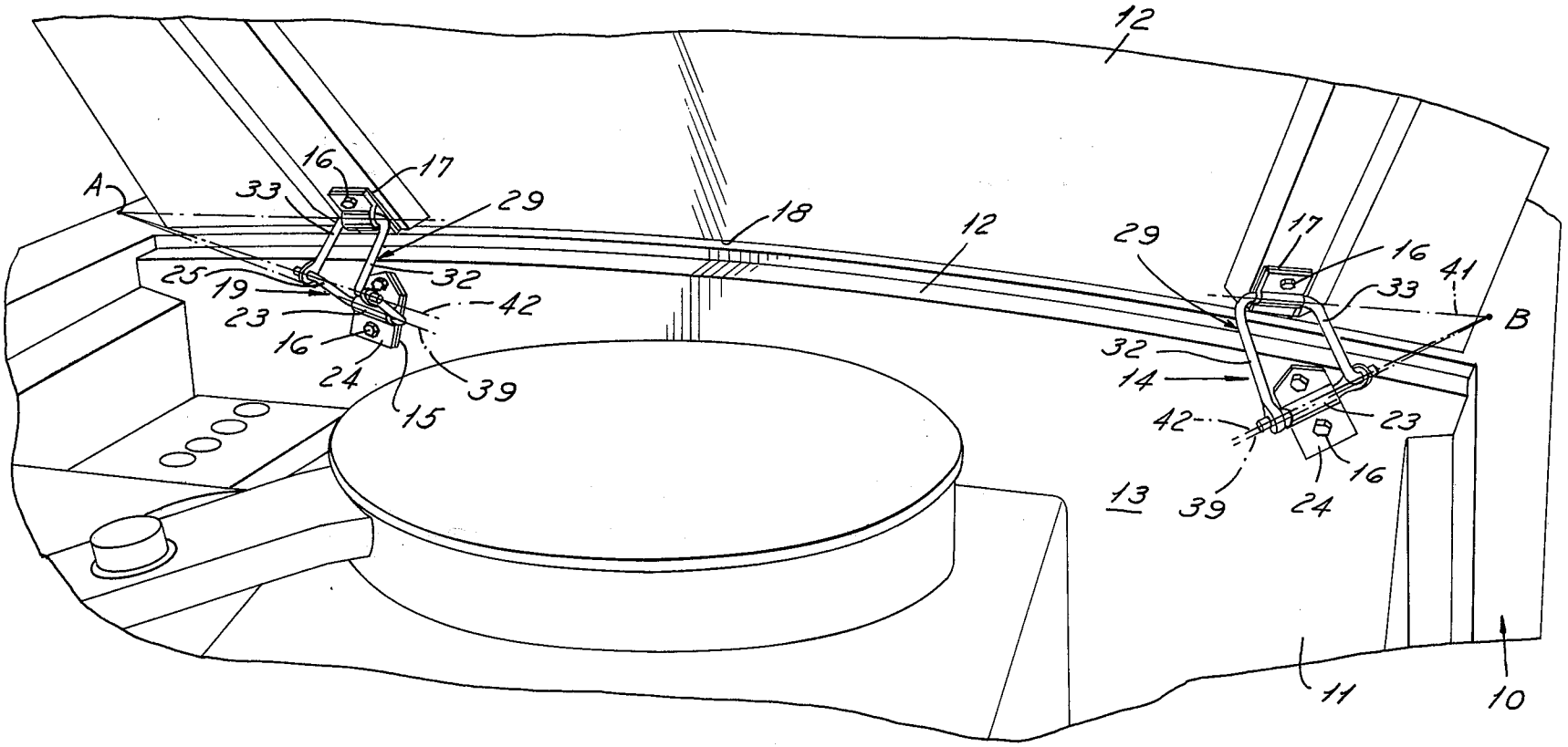
FIG. 1 is a fragmentary perspective view of the cowl end of a vehicle engine compartment illustrating a hinge system for mounting the compartment closure or hood thereon, the hinge system utilizing hinge devices in accordance with the present invention.
Figure 2:
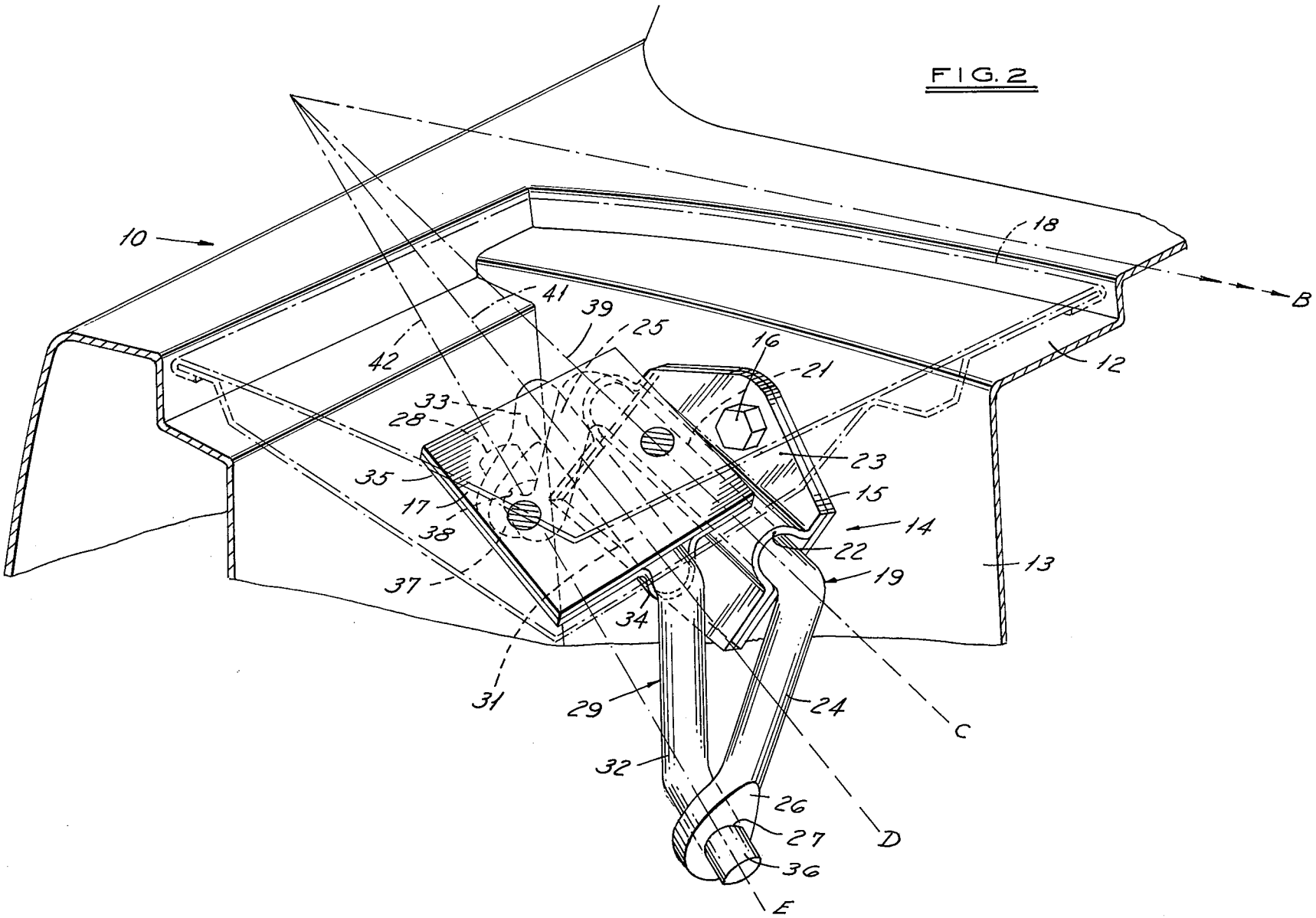
FIG. 2 is an enlarged view of one of the hinges of FIG. 1, the hinge device being shown in closure closed position.

Referring now more particularly to the drawings, it will be noted that FIG. 1 illustrates a portion of a vehicle body structure, generally designated 10, defining a compartment 11 open at its top and having a hinged closure 12 mounted for swinging movement into and out of compartment closed position. The compartment 10 is shown as a vehicle engine compartment and the closure 12 as the hood. It will be understood, however, that the compartment 10 could have been shown as a luggage compartment and the closure 12 as the deck lid for the luggage compartment.

The closure 12 is supported on the rear vertical wall 13 of the compartment 11 by a hinge system embodying the present invention. The hinge system comprises a pair of hinge devices, each designated 14, spaced laterally on the vehicle body structure. Each hinge device 14 has a first base plate 15 forming an attachment member fastened to the wall 13 by bolts 16 or the like at the upper boundary of the latter beneath the opening receiving the closure or hood 12. Each hinge device 14 has a second base plate 17 bolted or otherwise fastened to the underside of the closure or hood adjacent the rear edge 18 of the latter.

Each hinge device 14 has a first hinge member 19 pivotally coupled to first base plate 15. As best seen in FIG.'s 2 and 3, the first hinge member 19, as exemplified, is formed of rod stock of cylindrical cross section. This hinge member 19 is formed in a substantially U-shape with its base 21 elongated and journaled within a semi-tubular channel 22 formed in a plate 23 overlying the base plate 15. The hinge member 19 has parallel upstanding legs 24 and 25 with the leg 24 somewhat longer than the leg 25.

The leg 24 terminates in a flattened end portion 26 having an aperture 27 therein. The leg 25 terminates in a right angle end portion 28 axially aligned with the axis of the aperture 27.

Each hinge device 14 has a second hinge member 29 pivotally coupled to the second base plate 17. As in the case of the first hinge member 19, the second hinge member 29 is formed of rod stock of cylindrical cross section and is of substantially U-shape with an elongated base 31 and parallel legs 32 and 33 extending at right angles to each end of the base. The base 31 is journaled within a semi-tubular channel 34 formed in a plate 35 overlying the base plate 17. The leg 32 is somewhat longer than the leg 33 and terminates in an outwardly turned right angle end portion 36 which is journaled in the aperture 27 of the leg 24 of the hinge member 19. The shorter leg 33 has a flattened end portion 37 having an aperture 38 receiving the right angle end portion 28 on the leg 25 of the hinge member 19.

From the foregoing it is thus seen that each hinge device 14 comprises a first attachment member in the form of a base plate 15 attached to the vehicle body wall 13 and the second attachment member in the form of a base plate 17 attached to the closure 12. A first hinge member 19 is pivotally coupled to the attachment member for swinging movement about a pivot axis 39 defined by the axis of the base portion 21 of the hinge member 19. A second hinge member is pivotally coupled to the second attachment for swinging movement about a pivot axis 41 defined by the axis of the base portion 31 of the hinge member 29. The two hinge members 19 and 29 are pivotally coupled to each other at their distal ends, the ends of the respective arms 24–32 and 25–33. The cylindrical end portion 36 of arm 32 is journaled in the aperture 27 in the end portion 26 of the arm 24 and the cylindrical end portion 28 of arm 25 is journaled in the aperture 38 in the end portion 37 of arm 33. The cylindrical end portions 28 and 36 are axially aligned and define a pivot axis 42 about which the hinge members 19 and 29 are swingable relative to one another.

Figure 3:
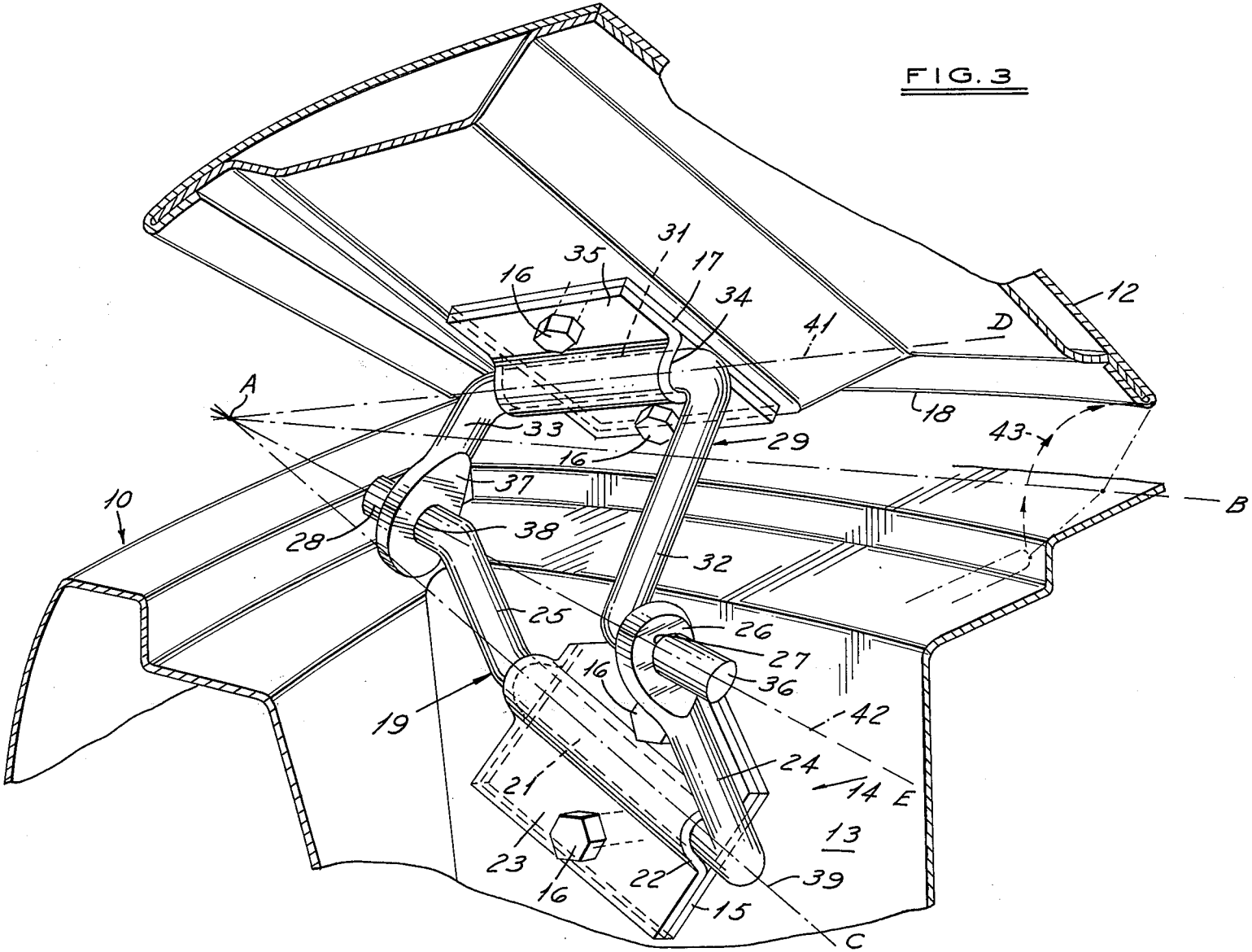
FIG. 3 is a view in part similar to FIG. 1 showing the hinge in closure opened position.

The axes 39, 41 and 42 of each hinge device 14 are obliquely positioned relative to one another and intersect at a point outside of and above the surface of the closure 12 when the latter is in closed position in the compartment opening to provide externally of the opening a pivot point about which the closure is swingable to and from an opened position. In FIG. 3, the itersection point of the three axes 39, 41 and 42 is labeled "A". Referring to FIG. 1, the corresponding intersection on the opposite side of the vehicle for the opposite hinge 19 is labeled "B". The line A-B represents the desired hinge line or axis about which the closure 12 is bodily swingable.

Figure 4:
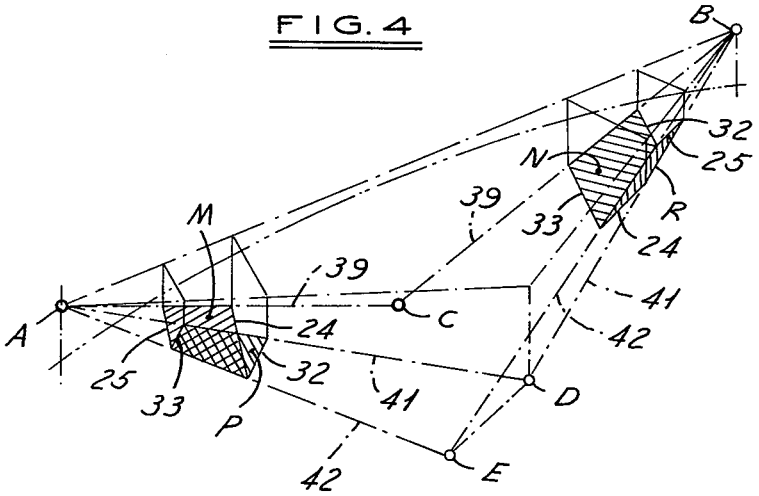
FIG. 4 is a diagramatic representation of the hinge system of FIG. 1.

Reference now is made to FIG. 4 for a diagramatic representation and explanation of the hinge system that has been structurally described above. Line A–B represents a desired closure (hood, deck lid or door) pivot line or hinge axis. Lines A–C and B–C are the pivot axes of the hinge members 19, the lines A–C and B–C corresponding to the pivot axis 39 of each hinge device 14. Lines A–D and B–D are the pivot axes of the hinge members 29, the lines A–D and B–D corresponding to the pivot axis 41 of each hinge device 14.

Primary links M and N are attached to the vehicle wall 13 through the attachment members 15 for swinging movement about pivot axes A–C and B–C (axis 39 of each hinge device 14). The primary link M comprises the coacting arms 24–25 of the left hinge member 19 as viewed in FIG. 1. Correspondingly, the primary link N comprises the coacting arms 24–25 of the right hinge member 19, as viewed in FIG. 1. Secondary links P and R are attached to the closure for swinging movement about pivot axes A-D and B-D (axis 41 of each hinge). The secondary link P comprises the coacting arms 32–33 of the left hinge member 19 and the secondary link R comprises the coacting arms 32–33 of the right hinge member 19, as viewed in FIG. 1.

The primary links M and N are joined to the secondary links P and R along lines A–E and B–E, respectively. The lines A-E and B-E correspond to pivot axis 42 of each hinge 14. As noted above, all hinge pivot lines or axes intersect at points "A" and "B", respectively.

In operation, since the hinge pin of link P, that is, the hinge pin extending along line A–E or 42 of the left hinge, can only operate in line with point "A" and the hinge pin of link R, that is the hinge pin extending along line B–E or 42 of the right hinge, can only operate in line with point "B", as viewed in FIG. 1, and both are attached to closure 12 along pivot lines A–D and B–D or 41 of each hinge, the closure can radiate only around the line extending between "A" and "B", as indicated by the line 43 in FIG. 1.

The present invention thereby utilizes a system of opposing hinge joints which cause the compound attaching links to describe a definite travel and positioning movement. In automotive applications (but not limited thereto), this concept allows greater freedom from surface configuration hinge limitations and is readily adaptable to inside surface mounting, such as on the inner cowl top or the upper back panel reinforcements of the vehicle body structure. The relative angle of the opposing hinge pins also makes it possible that this concept can be used for side doors (typically vertical hinge line) to permit door swing away in an attitude more conductive of ingress and egress requirements. In a normal application for a deck lid or a hood, a natural hold open feature can be obtained by the use of a tension spring operating between the idler hinge pin joint (of the primary to secondary link joint) of the opposing hinge assemblies.

Figure 5:
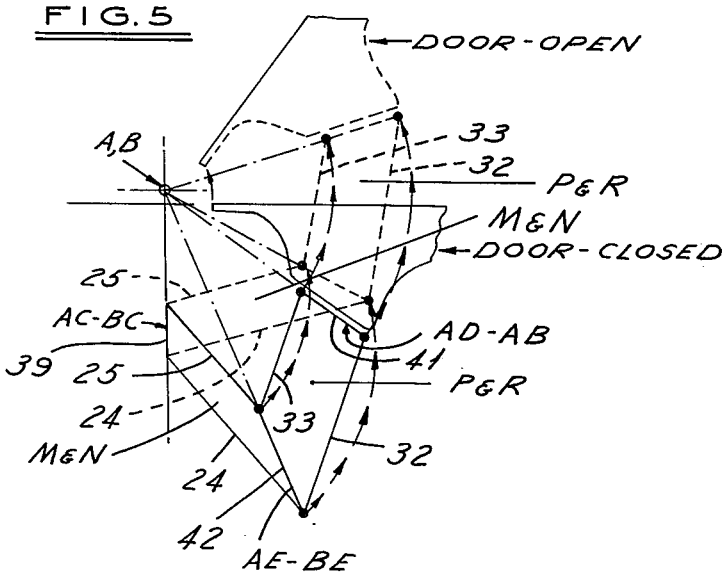
FIG. 5 is a diagramatic representation of the hinge system when applied to a closure swingable about an upright axis instead of a substantially horizontal axis as shown in FIG. 4.

The angles and mouting attitudes of the hinge assemblies are limited only by the outside surface configuration and the desired location of the common instant center points (A and B). Thus in a side door application, these pivoting control points can be above the vehicle and below the ground with any desired vertical angle. The application of the hinge system to a vehicle side door is diagramatically illustrated in FIG. 5. Since the reference numerals apply to FIG. 5 are the same as those applied to FIG. 4, no detailed explanation is believed necessary.

Although the several links have been illustrated as being formed of rod stock, it will be understood that the links may be formed of sheet metal stampings coupled to each other by pivot pins.

It is to be understood that this invention is not limited to the exact construction illustrated and described above, with various changes and modifications may be made withoug departing from the parent scope of the invention as defined by the following claims:

I claim:

1. A hinge device for mounting in an opening in a structure, such as a vehicle body, a closure for swingable movement between closed and opened positions, comprising:

a first attachment member mounted on a structural member of the structure at one boundary of the opening and the second attachment member mounted on the closure, the first attachment member being mounted internally of the opening and the second attachment member being mounted on the inner side of the closure, a first hinge member pivotally coupled to the first attachment member for swinging movement about a first axis, a second hinge member pivotally coupled to the second attachment member for swinging movement about a second axis, pivot means pivotally coupling the distal ends of the first and second hinge members to each for swinging movement about a third axis intermediate the first and second axes, the hinge device being mounted with its three axes obliquely positioned relative to one another and intersecting at a point outside of the surface of the closure when the latter is in a closed position in the structure opening to provide externally of the closure a pivot point about which the closure is swingable to and from an opened position.

2. A hinge according to claim 1, in which:

the first axis about which the first hinge member is swingable extends substantially laterally of the closure, the second axis about which the second hinge member is swingable extends substantially laterally of the opening, and the intersection point of the three axes lies above the opening at the boundary of the latter defined by the body structural member.

3. A hinge system for supporting in an opening in each structure, such as a vehicle body, a closure for movement between closed and opened positions, comprising:

a pair of hinge devices spaced from each other, each hinge device having a first attachment member mounted on a structural member of the structure at one boundary of the opening and the second attachment member mounted on the closure, each first attachment member being mounted internally of the opening and each second attachment member being mouned on the inner side of the closure, each hinge device having a first hinge member pivotally coupled to its first attachment member for swinging movement about a first axis and a second hinge member pivotally coupled to its second attachment member for swinging movement about a second axis, and pivot means pivotally coupling distal ends of the first and second hinge members of each hinge device to each other for swinging movement about a third axis intermediate the first and second axes, all three axes of each hinge device being angularly oriented relative to one another and intersecting at a point outside of the surface of the closure when the latter is in closed position in the structure opening to provide a pivot point externally of the opening;

the pair of pivot points provided by the pair of hinge device coacting to define an external hinge axis about which the closure is swingable to and from an opened position.

4. A hinge system according to claim 3, in which:

the first axis about which each first hinge member is swingable extends substantially laterally of the closure, the second axis about which each second hinge member is swingable extends substantially laterally of the opening, and the intersection point of the three axes of each hinge device lies above the opening at the boundary of the latter defined by the body structural member.

5. A hinge system constructed and arranged to provide an external hinge axis about which a closure is swingable to and from closed and opened positions in an opening in a structure, such as a vehicle body, the hinge axis having predetermined end points A and B externally of the closure when the latter is in closed position, a first pair of spaced attachment members attached to a structural member at an edge of the opening internally of the latter and a second pair of attachment members attached to the closure on the underside thereof, hinge pin means journaled in each of said first pair of attachment members defining hinge pivot lines A–C and B-C, respectively, hinge pin means journaled in each of said second pair of attachment members defining hinge pivot lines A–D and B–D, a pair of primary links M and N journaled on the hinge pin means journaled in the first pair of attachment members, the primary links M and N being swingable about the hinge pivot lines A–C and B–C, respectively, a pair of secondary links P and R journaled on the hinge pin means journaled in the second pair of attachment members, the secondary links P and R being swingable about the hinge pivot lines A–D and B–D, respectively, a hinge pin means joining the primary links M and N to the secondary links P and R along pivot lines A–E and B–E, respectively, hinge pivot lines A–C, A–D and A–E intersecting at point A and hinge pivot lines B–C, B-D and B–E intersecting at point B, respectively, whereby, since the hinge pin means of link P along pivot line A–E can only operate in line with point A and the hinge pin means of link R along pivot line B-E can only operate in line with point B, and both links P and R are attached to the closure on pivot lines A–D and B–D, the closure can only radiate around the hinge axis A–B.

6. A hinge system according to claim 5, in which:

hinge pivot lines A–D and B–D are swingable about hinge axis A–B with the closure.

* * * * *